US006538544B1

(12) United States Patent
Hardy

(10) Patent No.: US 6,538,544 B1
(45) Date of Patent: Mar. 25, 2003

(54) PNEUMATICALLY ACTUATED MAGNETIC WORKPIECE HOLDER

(75) Inventor: Paul Hardy, Elmira, MI (US)

(73) Assignee: Industrial Magnetics, Inc., Boyne City, MI (US)

( * ) Notice: Subject to any disclaimer, the term of this patent is extended or adjusted under 35 U.S.C. 154(b) by 41 days.

(21) Appl. No.: 09/603,865

(22) Filed: Jun. 26, 2000

(51) Int. Cl.[7] ..... B66C 1/04; H01F 7/20

(52) U.S. Cl. ..... 335/285; 335/295; 294/65.5; 294/88

(58) Field of Search ..... 335/285–288, 335/295; 269/8; 294/65.5, 88

(56) References Cited

U.S. PATENT DOCUMENTS

| | | | | |
|---|---|---|---|---|
| 4,504,088 A | | 3/1985 | Carter | |
| 5,266,914 A | * | 11/1993 | Dickson et al. | 335/288 |
| 5,409,347 A | * | 4/1995 | Suzuki | 414/737 |
| 5,428,331 A | * | 6/1995 | Graner et al. | 335/285 |
| 5,845,950 A | | 12/1998 | Stowe et al. | |
| 6,086,125 A | * | 7/2000 | Kovacs et al. | 294/65.5 |
| 6,168,221 B1 | * | 1/2001 | Carruth et al. | 294/65.5 |

* cited by examiner

*Primary Examiner*—Ramon M. Barrera

(74) *Attorney, Agent, or Firm*—Young & Basile, P.C.

(57) ABSTRACT

A pneumatically actuated magnetic workpiece holder comprising a housing having a contact surface for contacting a workpiece to be held, and a magnet assembly translationally disposed in the housing, the magnet assembly comprising a plurality of permanent magnets arranged so that adjacent magnets are of opposite polarities. The housing is adapted for fluid communication with a pneumatic supply. The magnet assembly is biased towards an operative position, according to which the magnet assembly is sufficiently near the contact surface to exert on a workpiece an attractive force sufficient for holding the workpiece in contact with the workpiece holder, and is translationally positionable by pneumatic pressure towards an inoperative position, according to which the magnet assembly is sufficiently distant from the contact surface so as to be unable to exert on the workpiece an attractive force sufficient for holding the workpiece in contact with the workpiece holder. The invention is adapted for replacing suction-cup workpiece holders in conventional vacuum lifting devices, and a method of utilizing the present invention in this fashion is taught to comprise providing the workpiece holder with a coupling complimentary to the coupling for such conventional suction-cup workpiece holders, so that the magnetic workpiece holder may be substituted for the conventional suction-cup holder in the vacuum lifting device. According to this method, the vacuum supply of the conventional vacuum lifting device is adapted to provide such positive air pressure for employing the magnetic workpiece holder of this invention.

23 Claims, 2 Drawing Sheets

Fig. 1A
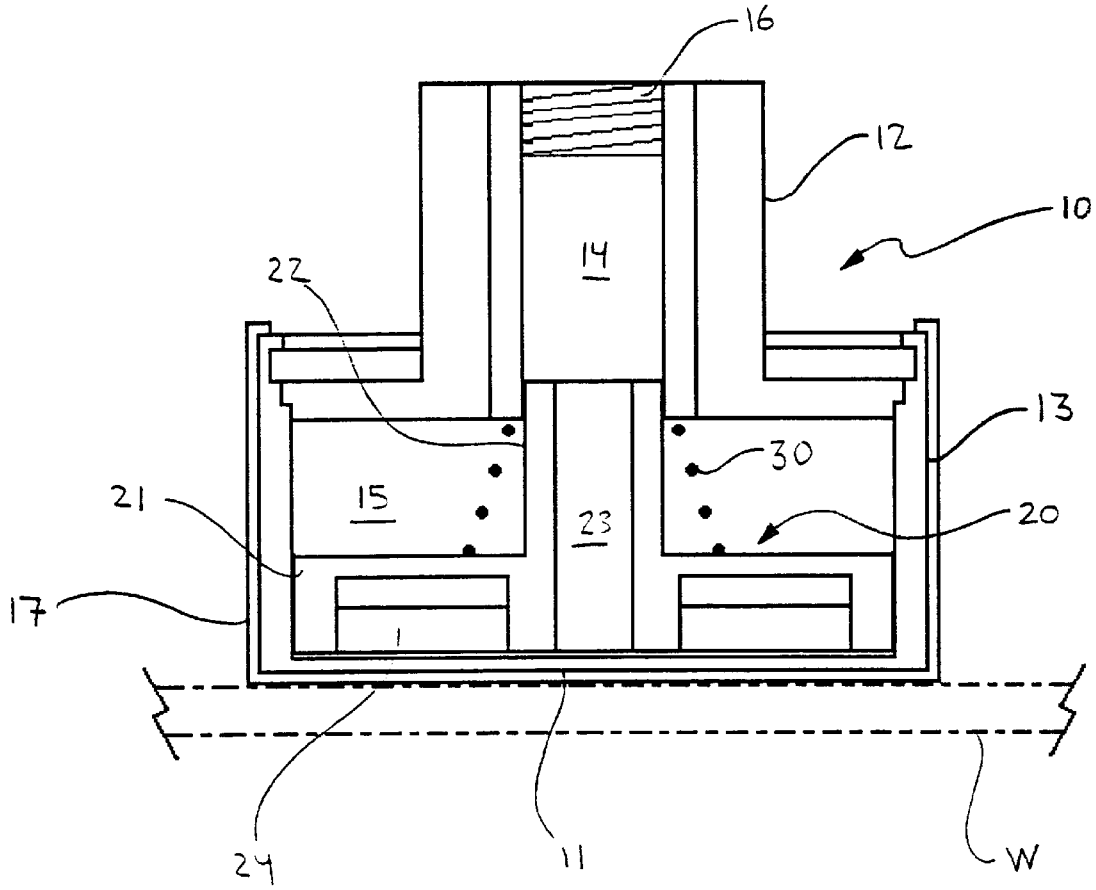
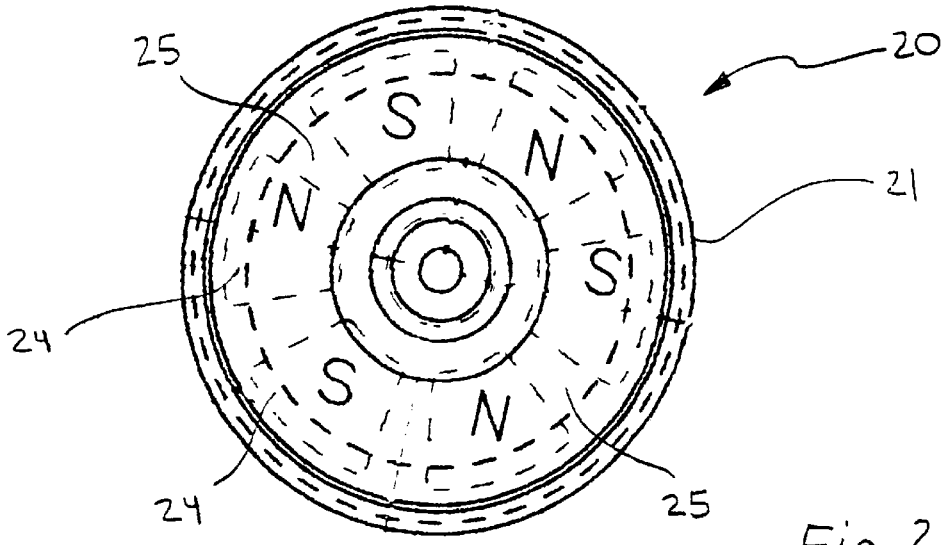
Fig. 2

PNEUMATICALLY ACTUATED MAGNETIC WORKPIECE HOLDER

FIELD OF THE INVENTION

The present invention relates generally to workpiece holders, and more particularly to pneumatically actuated magnetic workpiece holders and a method for their use with conventional vacuum-type lifting devices.

BACKGROUND OF THE INVENTION

Many manufacturers, including automobile manufacturers, incorporate into their factories lifting assemblies which are manually, mechanically, or robotically operated. These lifting assemblies are utilized to move very heavy workpieces, often made from sheet metal or the like, from one operational area of an assembly line to another. Manufacturers are continually endeavoring to make these lifting assemblies as safe, powerful, efficient, and inexpensive to operate as possible.

Lifting assemblies incorporate thereon or are provided with some type of device for holding an article or workpiece. Some of these devices include "hand"-like gripping devices. While these work in a generally satisfactory manner, such gripping devices are often cost-prohibitive since the gripping device is usually dedicated to one or a relatively few particularly-shaped workpieces. Thus, such gripping devices cannot be used to lift a wide variety of differently shaped workpieces.

Electromagnetic holding devices are able to hold a wide variety of workpieces, and can be quite capable of lifting heavy loads. However, such devices are often larger and heavier than may be desirable. Moreover, they consume large amounts of energy in order to continually magnetize the electromagnet. Consequently, such devices can be quite expensive to build and operate.

Less expensive and safer to use than other lifting devices are vacuum suction-cup holding devices, which are generally used today. These devices typically comprise a lifting assembly having removably connected thereto a suction-cup fitted workpiece holder, and a source of vacuum pressure, for instance a pneumatic supply capable of generating negative—or vacuum—pressure. Such vacuum holding devices are able to hold a wide variety of workpieces, can be used with reduced risk to the operator, and are generally powerful enough to lift desired loads. Unfortunately, vacuum holding devices also suffer drawbacks. In order to adequately hold and lift many workpieces, the vacuum cups must be relatively large. Further, both the suction cups and the surrounding work environment, must be kept free from dust, dirt, and other debris that might compromise the vacuum seal between the suction cup and workpiece. Further costs associated with vacuum holding devices arise from the necessity of maintaining a constant vacuum in order to hold a workpiece. This necessity for maintaining constant vacuum pressure also presents safety considerations, since a failure of the vacuum supply while a workpiece is being lifted poses obvious workplace hazards. Vacuum holding devices are also less desirable for applications where workpieces with curved or irregularly-shaped surfaces must be lifted and held, since vacuum cups require a relatively flat contact surface in order to create an efficient seal.

It would consequently be desirable to provide, with minimal cost, a simple and efficient workpiece holding device capable of securely holding workpieces of varying shapes and sizes.

SUMMARY OF THE DISCLOSURE

The present invention addresses and solves the problems discussed above, and encompass other features and advantages, by providing a pneumatically-actuated, magnetic workpiece holder comprising a housing having a contact surface for contacting a workpiece to be held, and a magnet assembly translationally disposed in the housing. The magnet assembly comprises a plurality of permanent magnets arranged so that adjacent magnets are of opposite polarities. The housing is adapted for fluid communication with a pneumatic supply. The magnet assembly is biased towards an operative position, according to which the magnet assembly is sufficiently near the contact surface to exert on a workpiece to be held an attractive force sufficient for holding the workpiece in contact with the workpiece holder, and is further translationally positionable by pneumatic pressure from the pneumatic supply towards an inoperative position, according to which the magnet assembly is sufficiently distant from the contact surface so as to be unable to exert on the workpiece to be held an attractive force sufficient for holding the workpiece in contact with the workpiece holder.

According to one feature of this invention, a polymeric boot or cover is provided for the contact surface to thereby prevent damage to the workpiece being held. The polymeric cover preferably comprises an ultra high molecular weight polymer, most preferably urethane.

According a further feature of this invention, the plurality of permanent magnets are further arranged radially about a central axis. Per yet another feature, the magnet assembly further comprises pole pieces positioned between the plurality of permanent magnets.

The permanent magnets are preferably formed from a rare earth metal, preferably selected from the group consisting of neodymium and samarium cobalt, with neodymium being most preferred. Other magnetic materials, such as ferrite and alnico, may also be used.

The magnetic workpiece holder of this invention is particularly adapted for replacing suction-cup workpiece holders in conventional vacuum lifting devices, and a method of utilizing the present invention in this fashion is taught to comprise providing the workpiece holder with a coupling complimentary to the coupling for such conventional suction-cup workpiece holders, so that the magnetic workpiece holder may be substituted for the conventional suction-cup holder in the vacuum lifting device. Further according to this method, the vacuum supply of the conventional vacuum lifting device, comprising a pneumatic supply capable of alternatively generating positive air pressure, is adapted to provide such positive air pressure for employing the magnetic workpiece holder of this invention.

BRIEF DESCRIPTION OF THE DRAWINGS

Other objects, features and advantages of the present invention will become apparent upon reference to the following description and drawings, in which:

FIG. 1A is an axial cross-section of the inventive magnetic workpiece holder, shown in the operative configuration thereof;

FIG. 2 is an end view of the magnetic assembly, illustrating the orientation and arrangement of the magnets thereof.

DETAILED DESCRIPTION OF THE ILLUSTRATED EMBODIMENT

Figure 1B:
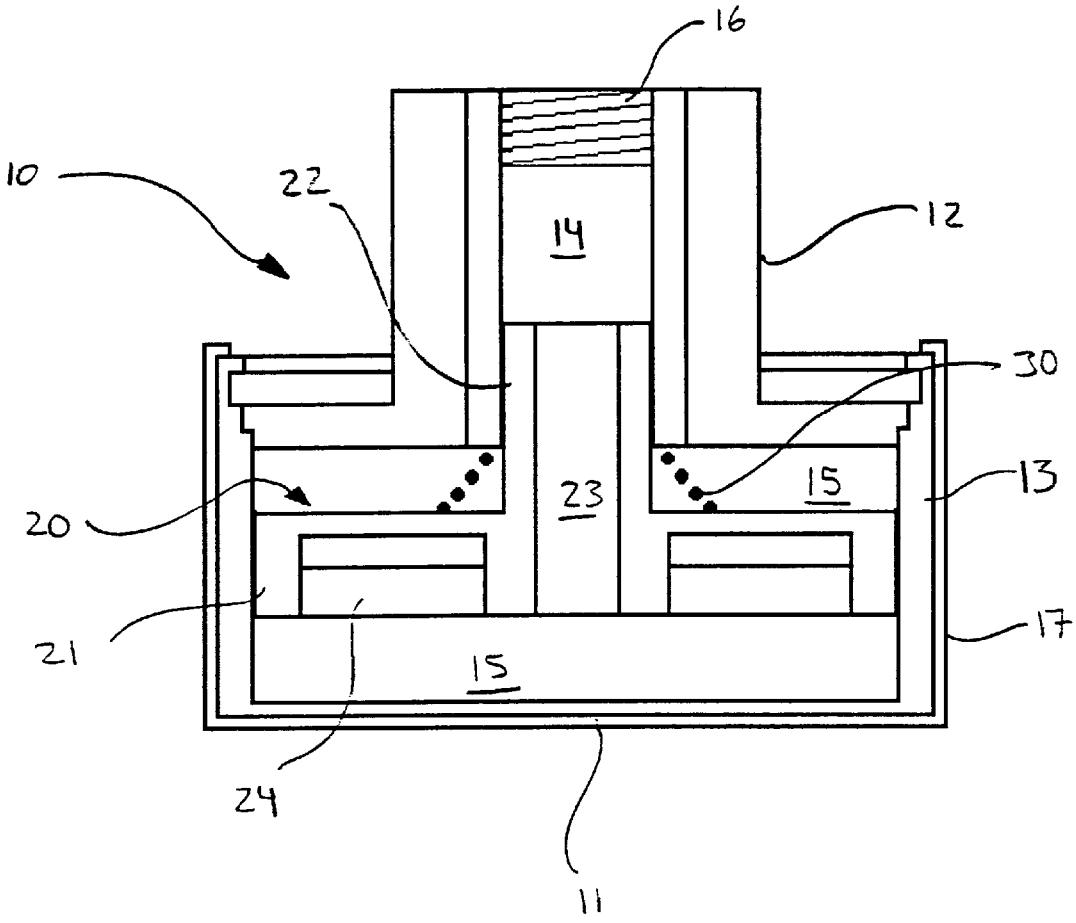
FIG. 1B is an axial cross-section of the inventive magnetic workpiece holder, shown in the inoperative configuration thereof.

Referring now to the drawings, wherein like numerals indicate like or corresponding parts, the present invention will be seen generally to comprise a pneumatically actuated magnetic workpiece holder having essentially a housing or body portion 10 with a first end including a contact surface 11 for contacting a workpiece W (indicated in phantom) to be held, and a magnet assembly 20 translationally disposed in the housing. FIG. 1A. The magnet assembly 20 is biased, for instance by the illustrated compression spring 30, toward an operative position, shown in FIG. 1A, wherein the magnet assembly 20 is sufficiently near the contact surface 11 so as to exert on the workpiece W an attractive force sufficient for holding the workpiece in contact with the workpiece holder. The magnet assembly 20 is further translationally positionable by pneumatic pressure, as explained herein, towards an inoperative position, shown in FIG. 1B, wherein the magnet assembly 20 is sufficiently distant from the contact surface 11 so as to be unable to exert on the workpiece (not shown) an attractive force sufficient for holding the workpiece in contact with the workpiece holder.

Without limitation, the magnetic workpiece holder of this invention may be used in conjunction with a conventional lifting assembly (not shown), such as those found in numerous production lines, including sheet metal production, automotive manufacturing, appliance and furniture manufacturing and the like. These conventional lifting assemblies typically move sheet metal parts, articles, or other workpieces from one work area to another—such as from one conveyor line to the next, from one operation area to the next, from one stamping press line to another, or from one press area to another—where the part, article, or other workpiece may be installed in place on a later stage of a product being fabricated (e.g., an automobile, piece of furniture, etc.) or another production operation performed.

Still referring to FIGS. 1A and 1B, the housing 10 more specifically includes an upper section 12 and a lower section 13, the lower section 13 being characterized by a larger diameter than the upper section 12. It will be appreciated that the shape of the housing 10 may be as desired, subject to the general limitations of providing therein a pneumatically actuated magnet assembly 20. The housing may be formed of any suitable material, such as stainless steel or the like. It is preferred that the housing 10 be formed from a material having few or no ferromagnetic properties, including, without limitation, aluminum, stainless steel, suitable polymers, carbon fiber, etc. As shown, the housing 10 is of multi-part construction; the upper 12 and lower 13 sections being formed separately and thereafter mated to form the unitary housing 10. However, it will be appreciated that the housing 10 could also be fashioned as one piece. The upper section 12 has defined therethrough a passageway 14 communicating with a chamber 15 defined in the lower section 13. The passageway 14 terminates in an opening at the end of the upper section 12, as shown, and is adapted for interconnection with a pneumatic supply, for instance by the illustrated threaded coupling 16. Most preferably, the threaded coupling 16 is adapted for interconnection with existing tooling, of industry standard sizes, particularly tooling on existing lifting assemblies adapted for connecting vacuum-powered, suction-cup workpiece holders, such as existing connections or couplings on tooling booms or robotic face plates. In most industrial applications for such vacuum-type workpiece holders, the pneumatic supply is equally capable of generating positive or negative (i.e., vacuum) pressure. Consequently, it is most preferred that the present invention be adapted to interconnect with the tooling for, and thereby replace, the suction-cup holders on such vacuum-type lifting devices. Since only a pulsing, rather than a constant, fluid pressure is required to operate the present invention, as described further hereinbelow, it will be appreciated that the workpiece holder of this invention is more economical as compared to lifting devices requiring a constant vacuum source.

Most preferably, a non-marring, polymer cover or boot 17 is provided to fit over the housing 10, and more particularly the lower section 13, and to cover the contact surface 11 to thereby reduce contact damage to the workpiece being held. Preferably, the boot 17 is made of a polymer sufficient to prevent slipping of the workpiece being held. Most preferably, an ultra high molecular weight polymer, such as urethane, is employed, through other materials may be substituted to the same end.

The magnet assembly 20 comprises a first, disk-like portion 21 dimensioned to fit sealingly within the chamber 15 so as to be capable of sliding translational movement axially upwards and downwards, and a smaller diameter stem portion 22. The stem portion 22 is dimensioned to fit sealingly within the passageway 14 so as to be capable of sliding translational movement axially upwards and downwards. Of course, the overall shape of the magnet assembly 20 may vary with the shape of the housing 10, for instance. Thus, for example, the portions 21 and 22 may vary in shape with the shapes of the chamber 15 and passageway 14, respectively. In the illustrated embodiment, the smaller dimensions of the stem portion 22 permit smaller dimensions for the passageway 14, and so confine the disk-like portion 21 to the chamber 15. To further facilitate translational movement of the magnet assembly 20 within the body 10, and improve sealing engagement between the magnet assembly 20 and the housing 10 a suitable lubricant, such as grease or oil, may be employed. Other means of achieving these objectives may of course be employed, as is known to those of skill in the art.

A compression spring 30 positioned over the stem portion 22 and extending between the disk-like portion 21 and the upper surface of the chamber 15, as illustrated, biases the magnet assembly 20 towards the contact surface 11, and therefore towards the operative position of the magnet assembly (FIG. 1A).

To facilitate movement of the magnet assembly 20 towards the inoperative position thereof, as herein described, positive fluid pressure, preferably air pressure from a suitable pneumatic source, is applied in the chamber 15 between the magnet assembly 20 and the contact surface 11 to urge the magnet assembly upwardly away from the workpiece being held. To this end, the magnet assembly 20 is adapted for fluid communication between the chamber 15 and a pneumatic supply (not shown) connected to the body portion 10 so that, by the application of a pulse of fluid pressure, the magnet assembly 20 may be urged towards the inoperative position thereof. More particularly, the magnet assembly 20 includes a continuous longitudinal passageway 23 extending completely through the disk-like portion 21 and the stem portion 22 to communicate the passageway 14 with the chamber 15.

Referring also to FIG. 2, the magnet assembly 20 comprises a plurality of magnets 24. The magnets 24 may be of any desired kind, though the use of permanent magnets, natural or man-made, is preferred, with magnets of rare earth metal, such as neodymium being most preferred. Neodymium is available as a powdered metal and is generally useable in block form. Although not as preferred, other rare earth metals, such as samarium cobalt, may be substituted. Still further, it is to be understood that non-rare earth metals, such as ferrite, may also be used. Also, alnico may be employed in higher temperature applications. The plurality of magnets 24 are preferably arranged so that the common faces of adjacent magnets are of opposite polarities (i.e., "N" or "S"), as depicted. Most preferably, the magnets 24 are further arranged in a common plane radially about the central axis of the magnet assembly 20, each magnet 24 being characterized by a wedge or trapezoidal-like shape. It is also most preferred to provide pole pieces 25 of a suitable ferromagnetic metal, such as steel, between adjacent magnets 24, as this improves the performance characteristics of the device.

Referring again to FIGS. 1A and 1B, operation of the present invention will be better understood.

The contact surface 11 of the workpiece holder is brought into contact with the workpiece W to be held (FIG. 1A); the magnet assembly 20 being biased towards a position adjacent the contact surface 11 by the urging of the spring 30. The workpiece W is magnetically attached to the workpiece holder by virtue of the attractive force of the constituent magnets 24 thereof, and may thereafter be moved by movement of the workpiece holder and associated lifting assembly. To release the workpiece from the workpiece holder, fluid pressure, such as a pulse or short burst of positive air pressure, is applied from the pneumatic source (not shown) through the passageway 14, the passageway 23, and so into the area of the chamber 15 below the magnet assembly 20, thereby urging the magnet assembly upwardly against the opposing force of the spring 30 and away from the contact surface 11 a sufficient distance so that the attractive force of the magnets 24 is insufficient to hold the workpiece against the contact surface 11. (FIG. 1B.)

Once the workpiece is disengaged from the workpiece holder in this fashion, it is of course necessary to evacuate the fluid from the chamber 15 before the magnet assembly 20 will return to its biased, operative position. Without limitation, this may be accomplished by venting means provided at the pneumatic supply or elsewhere upstream from the workpiece holder, for instance, or by simply disengaging the workpiece holder from the pneumatic supply.

It will be appreciated from the foregoing that the present inventive workpiece holder presents significant advantages over electromagnetic and vacuum-type article holders, including that the workpiece holder of this invention is adapted to engage and hold a workpiece in an unpowered condition; that is, whereas electromagnetic and vacuum-type article holders require a constant source of power or vacuum in order to engage and hold an article—and therefore present significant safety risks in the event of power or vacuum pressure loss—the present invention is biased towards engagement with a workpiece to be held by simple mechanical means (e.g., the compression spring). The present invention will thus continue to hold a workpiece even in the event the pneumatic supply fails. Only disengaging the workpiece from the workpiece holder requires an external source of fluid pressure, and then only in a brief pulse.

It will also be appreciated from this disclosure that the workpiece holder may be adapted so that the magnet assembly is urged towards its inoperative position by a pulse or short burst of negative (i.e., vacuum) pressure rather than positive pressure as particularly described. This may be accomplished, most simply, by closing off the passageway 23, for example, and applying a sufficient vacuum to draw the magnet assembly 20 upwardly against the biasing force of the spring 30.

It will also be appreciated that the communication of positive fluid pressure to the chamber 15 beneath the magnet assembly 20 in its operative position may take numerous paths in addition to that described herein as exemplary. Thus, for instance, the housing 10 may be adapted for connection with a pneumatic supply at the lower section 13, and a passageway therefore defined in the housing 10 from said connection directly to the area of the chamber 15 beneath the magnet assembly 20.

Of course, it will be appreciated that the foregoing is merely illustrative of the present invention, and that additional modifications and improvements thereto, apparent to those of skill in the art, are possible without departing from the spirit and broader aspects of this invention as set forth in the appended claims.

What is claimed is:

1. A pneumatically actuated magnetic workpiece holder, comprising:

a housing having a contact surface for contacting a workpiece to be held, said housing being adapted for fluid communication with a pneumatic supply;

a single chamber within said housing;

a magnet assembly translationally disposed in said chamber, said magnet assembly comprising a plurality of permanent magnets arranged so that adjacent magnets are of opposite polarities;

a single pneumatic supply inlet communicating with said chamber;

a single source of varying pneumatic pressure communicating with said chamber via said inlet; and wherein said magnet assembly is biased towards an operative position, according to which said magnet assembly is sufficiently near said contact surface to exert on a workpiece to be held an attractive force sufficient for holding the workpiece in contact with the workpiece holder, and is further translationally positionable by pneumatic pressure towards an inoperative position, according to which said magnet assembly is sufficiently distant from said contact surface so as to be unable to exert on the workpiece to be held an attractive force sufficient for holding the workpiece in contact with the workpiece holder.

2. The pneumatically actuated magnetic workpiece holder of claim 1, further comprising a polymeric cover for said contact surface.

3. The pneumatically actuated magnetic workpiece holder of claim 2, wherein said polymeric cover comprises an ultra high molecular weight polymer.

4. The pneumatically actuated magnetic workpiece holder of claim 3, wherein said ultra high molecular weight polymer comprises urethane.

5. The pneumatically actuated magnetic workpiece holder of claim 1, wherein said plurality of permanent magnets are further arranged radially about a central axis.

6. The pneumatically actuated magnetic workpiece holder of claim 1, wherein said magnet assembly further comprises pole pieces positioned between said plurality of permanent magnets.

7. The pneumatically actuated magnetic workpiece holder of claim 1, wherein said permanent magnets are formed from a rare earth metal.

8. The pneumatically actuated magnetic workpiece holder of claim 7, wherein said rare earth metal is selected from the group consisting of neodymium and samarium cobalt.

9. The pneumatically actuated magnetic workpiece holder of claim 7, wherein said rare earth metal is neodymium.

10. The pneumatically actuated magnetic workpiece holder of claim 1, wherein said plurality of permanent magnets are formed from a magnetic material selected from the group consisting of ferrite and alnico.

11. The pneumatically actuated magnetic workpiece holder of claim 1, wherein said single pneumatic supply inlet comprises a threaded coupling formed in said housing wherein said threaded coupling engages a lifting assembly adapted to position said holder in relation to said workpiece.

12. In the method of utilizing vacuum-type lifting devices having lifting assemblies having one or more vacuum suction cup workpiece holders removably connected to a lifting assembly at a coupling, said vacuum suction cup workpiece holders being operatively connected to a pneumatic supply capable of generating positive and negative pressure, the method for adapting said vacuum-type lifting device to serve as a magnetic lifting device, comprising the steps of:

providing one or more pneumatically actuated magnetic workpiece holders, each comprising:

a housing having a contact surface for contacting a workpiece to be held, said housing being adapted for fluid communication with said pneumatic supply;

a single chamber within said housing;

a single pneumatic supply inlet communicating with said chamber;

a magnet assembly translationally disposed in said chamber, said magnet assembly comprising a plurality of permanent magnets arranged so that adjacent magnets are of opposite polarities, and wherein said magnet assembly is biased towards an operative position, according to which said magnet assembly is sufficiently near said contact surface to exert on a workpiece to be held an attractive force sufficient for holding the workpiece in contact with the workpiece holder, and is further translationally positionable by positive pressure towards an inoperative position, according to which said magnet assembly is sufficiently distant from said contact surface so as to be unable to exert on the workpiece to be held an attractive force sufficient for holding the workpiece in contact with the workpiece holder;

replacing said one or more vacuum suction-cup workpiece holders with said one or more pneumatically-actuated magnetic workpiece holders by connecting each said one or more pneumatically-actuated magnetic workpiece holders to said lifting assembly at said coupling; and adapting said pneumatic supply to generate positive pressure operative to urge said magnet assembly of each pneumatically-activated magnetic workpiece holder towards the inoperative position thereof.

13. The method of claim 12, further comprising the step of providing a polymeric cover for said contact surface of said pneumatically-actuated magnetic workpiece holder.

14. The method of claim 13, wherein the step of providing said polymeric cover comprises providing an ultra high molecular weight polymer cover.

15. The method of claim 14, where in the step of providing s aid polymeric cover comprises providing an ultra high molecular weight polymer cover of urethane.

16. The method of claim 12, wherein said step of providing said pneumatically-actuated magnetic workpice holder fulrther includes providing that said plurality of permanent magnets are fuirther arranged radially about a central axis.

17. The method of claim 12, wherein said step of providing said pneumatically-actuated magnetic workpiece holder further includes providing that pole pieces are positioned between said plurality of permanent magnets.

18. The method of claim 12, wherein said step of providing said pneumatically-actuated magnetic workpiece holder further includes providing that said plurality of permanent magnets are formed from a rare earth metal.

19. The method of claim 18, wherein said step of providing that said plurality of permanent magnets are formed from a rare earth metal further comprises providing that said rare earth metal is selected from the group consisting of neodymium and samarium cobalt.

20. The method of claim 18, wherein said step of providing that said plurality of permanent magnets are formed from a rare earth metal further comprises providing that said rare earth metal is neodymium.

21. The method of claim 12, wherein said step of providing said pneumatically-actuated magnetic workpiece holder further includes providing that said plurality of permanent magnets are formed from a magnetic material selected from the group consisting of ferrite and alnico.

22. The method of claim 12, wherein said housing fuirther includes a single pneumatic supply inlet comprising a single threaded coupling.

23. The method of claim 22, wherein said threaded coupling comprises the structural and pneumatic connection between said one or more magnetic workpiece holders and said lifting assembly.

* * * * *